US012516866B2

(12) United States Patent
Lee et al.

(10) Patent No.: US 12,516,866 B2
(45) Date of Patent: Jan. 6, 2026

(54) HOME APPLIANCES

(71) Applicant: LG ELECTRONICS INC., Seoul (KR)

(72) Inventors: Junghun Lee, Seoul (KR); Sungwook Kim, Seoul (KR); Namgyo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 94 days.

(21) Appl. No.: 18/278,059

(22) PCT Filed: Mar. 11, 2022

(86) PCT No.: PCT/KR2022/003437

§ 371 (c)(1),
(2) Date: Aug. 21, 2023

(87) PCT Pub. No.: WO2022/255603

PCT Pub. Date: Dec. 8, 2022

(65) Prior Publication Data

US 2024/0133612 A1 Apr. 25, 2024
US 2024/0230206 A9 Jul. 11, 2024

(30) Foreign Application Priority Data

Jun. 1, 2021 (KR) ..... 10-2021-0070680

(51) Int. Cl.
*F25D 23/00* (2006.01)

(52) U.S. Cl.
CPC .... *F25D 23/003* (2013.01); *F25D 2323/0021* (2013.01); *F25D 2323/00261* (2013.01); *F25D 2323/00271* (2013.01)

(58) Field of Classification Search
CPC ..... F25D 23/003; F25D 2323/0021; F25D 2323/00261; F25D 2323/00271; F25D 2323/0023; F25D 2317/063
See application file for complete search history.

(56) References Cited

FOREIGN PATENT DOCUMENTS

| | | | | | |
|---|---|---|---|---|---|
| CN | 112303979 | A | * | 2/2021 | ..... F25D 11/00 |
| KR | 20140091290 | A | * | 7/2014 | ..... F25D 23/003 |
| KR | 20160029636 | A | * | 3/2016 | ..... F25D 17/04 |

OTHER PUBLICATIONS

English language translation KR20140091290. Translated Apr. 2025. (Year: 2014).*
English language translation of CN11203979. Translated Apr. 2025. (Year: 2021).*
English language machine translation of KR20160029363 to Kim et al. Translated Apr. 2025 (Year: 2016).*

* cited by examiner

*Primary Examiner* — Cassey D Bauer
(74) *Attorney, Agent, or Firm* — Fish & Richardson P.C.

(57) ABSTRACT

A home appliance includes air inlets and air outlets that are defined at a machine room cover and configured to have flow rates different from each other. Accordingly, a design for the volume of air introduced into a machine room and the volume of air discharged to the outside of the machine room from the inside thereof may be facilitated.

15 Claims, 9 Drawing Sheets

[Fig. 1]
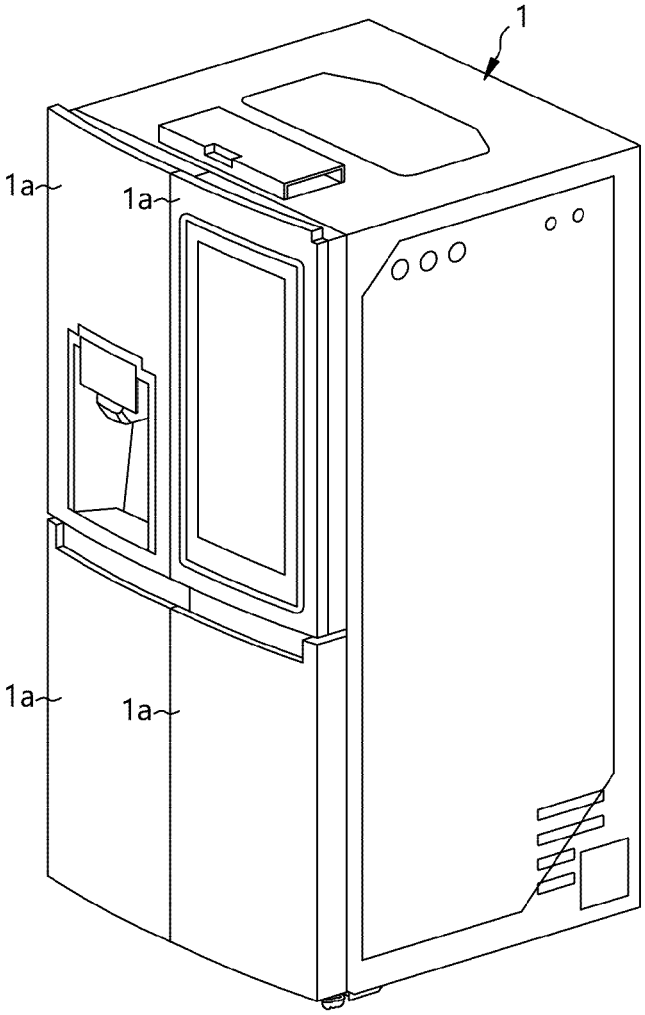

[Fig. 2]
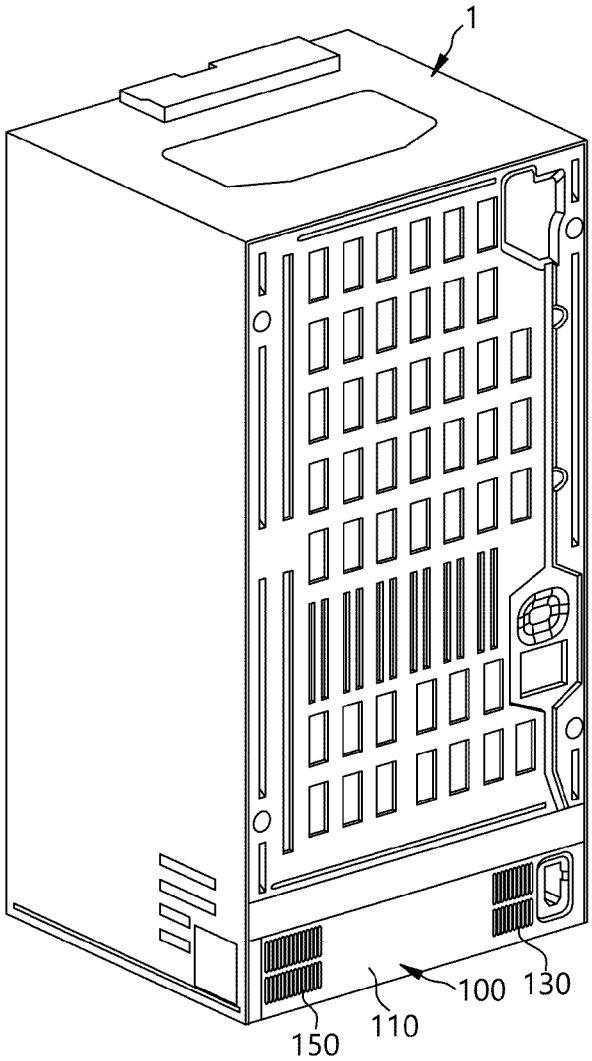

[Fig. 3]
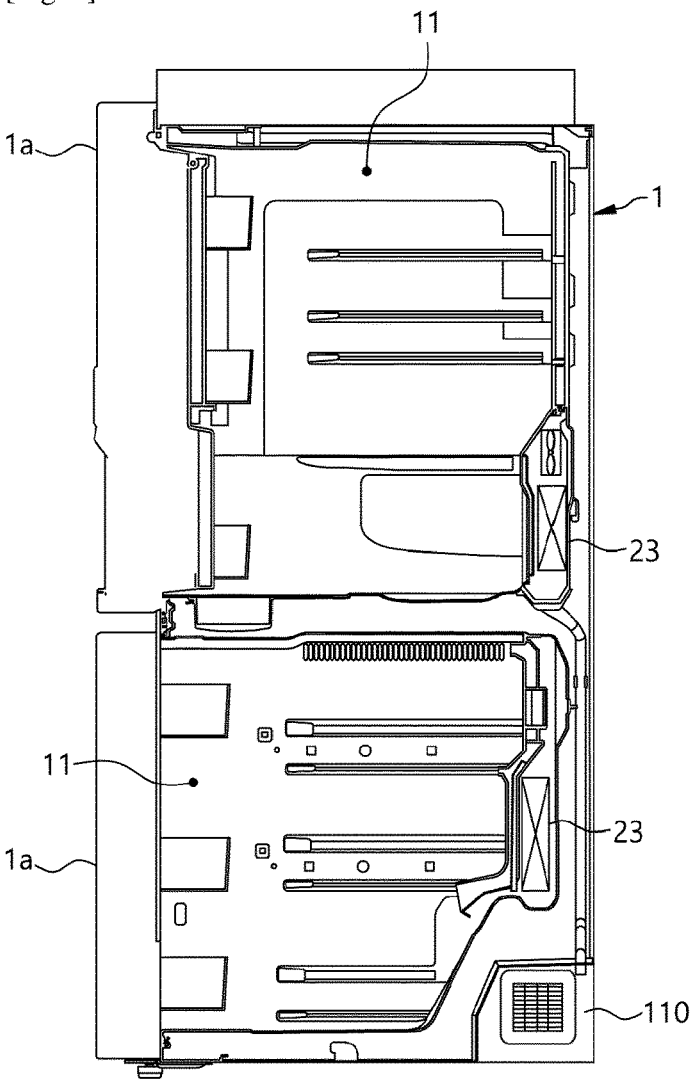
[Fig. 4]
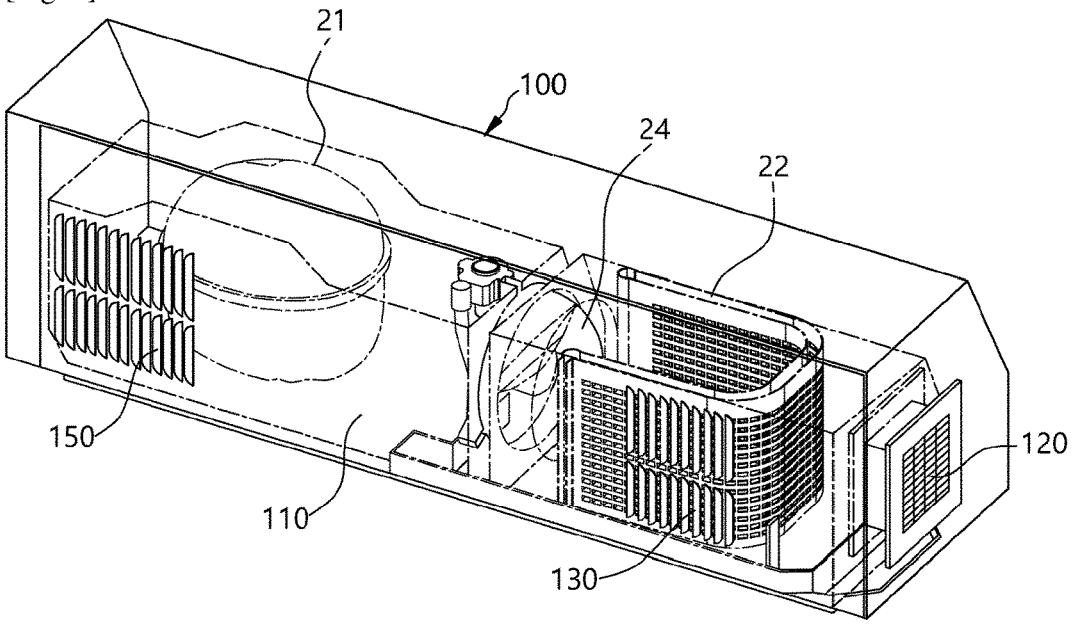

[Fig. 5]
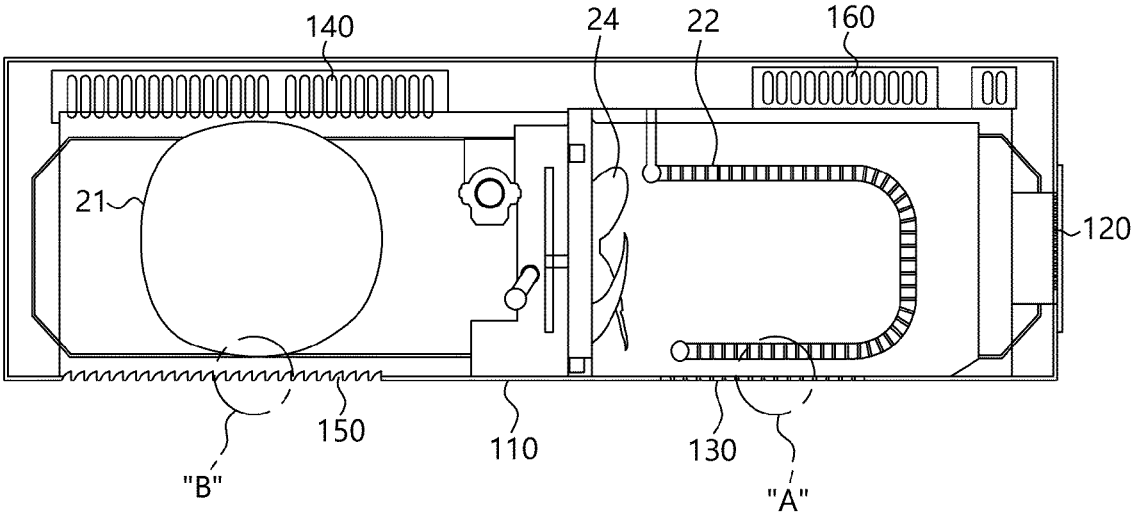
[Fig. 6]
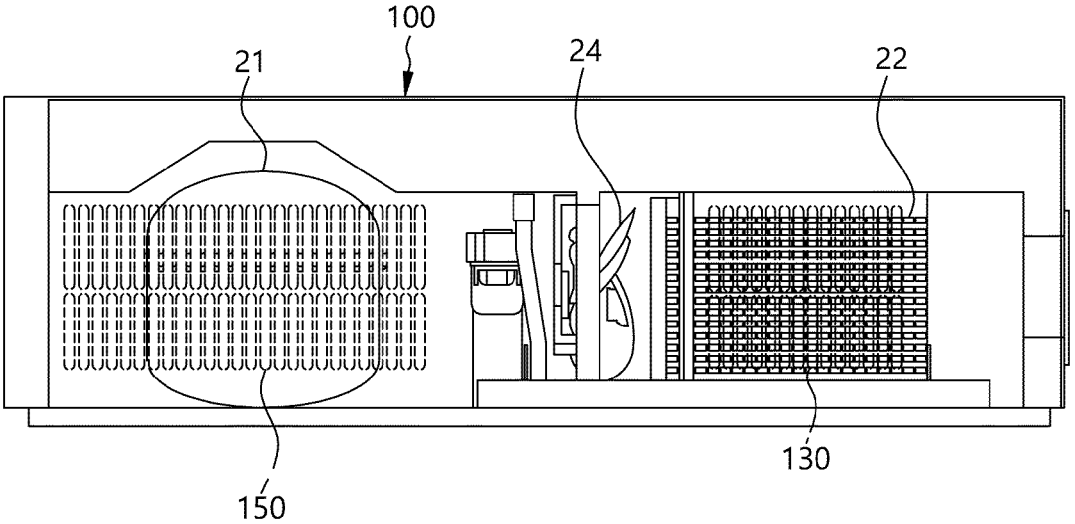
[Fig. 7]
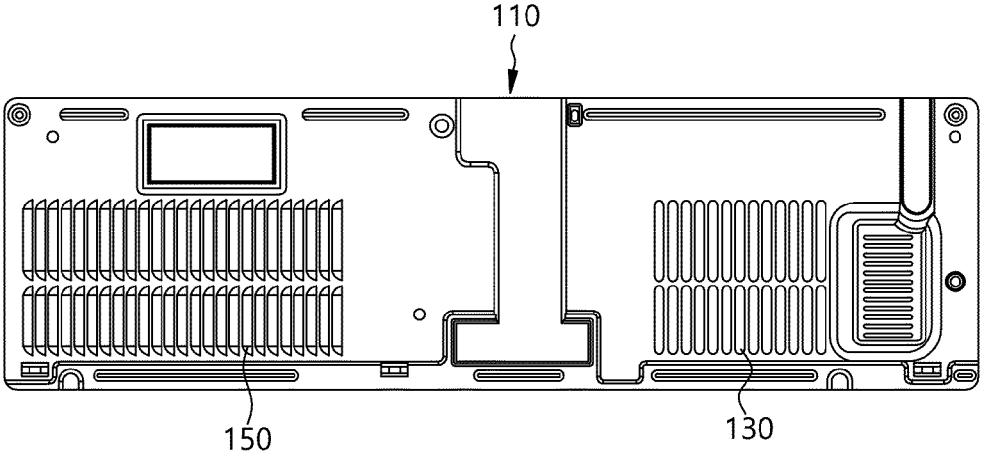

[Fig. 8]
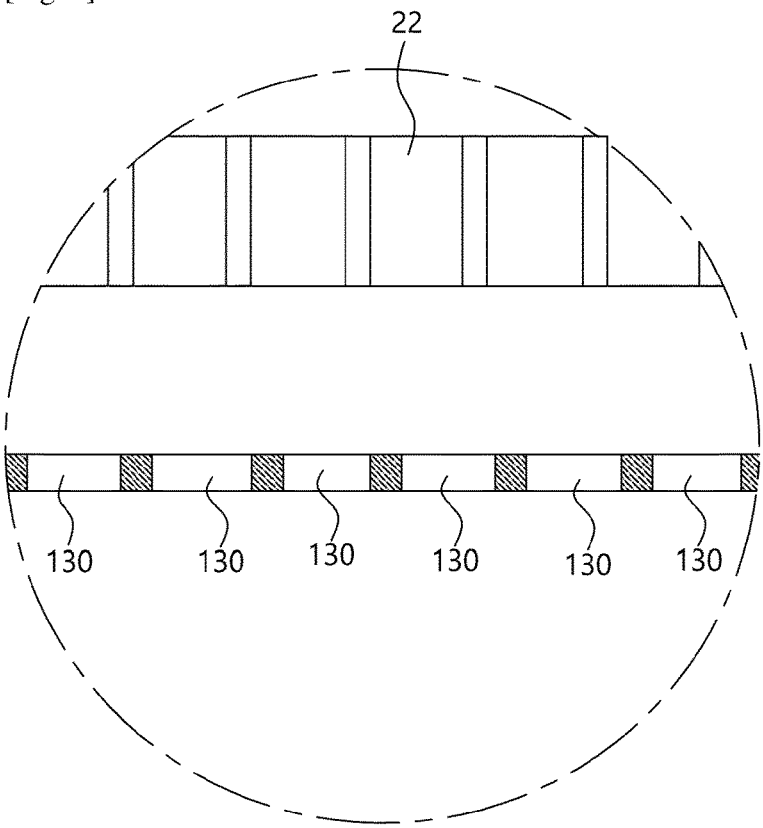
[Fig. 9]
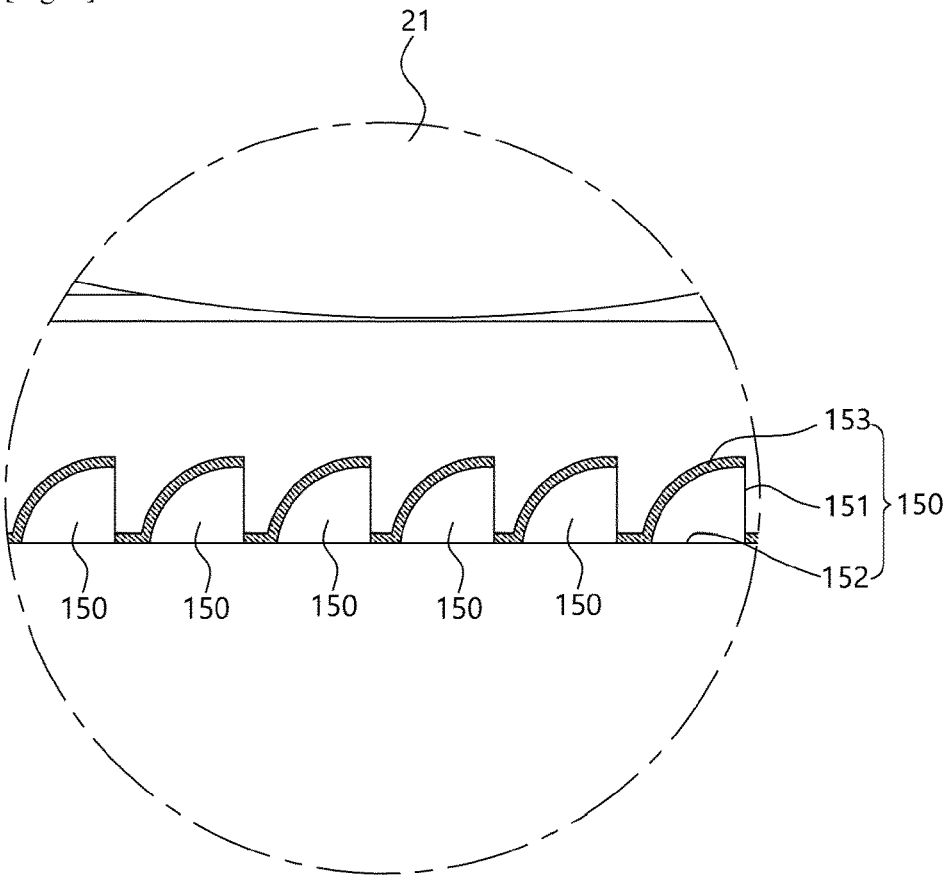

[Fig. 10]
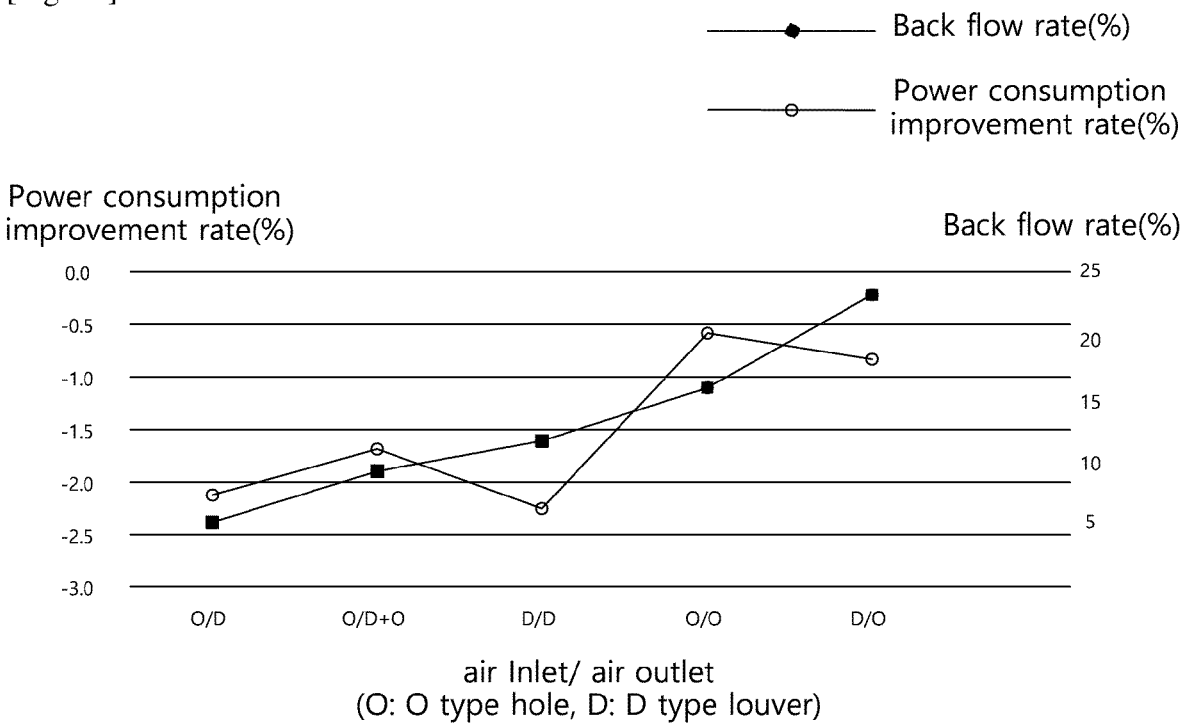
[Fig. 11]
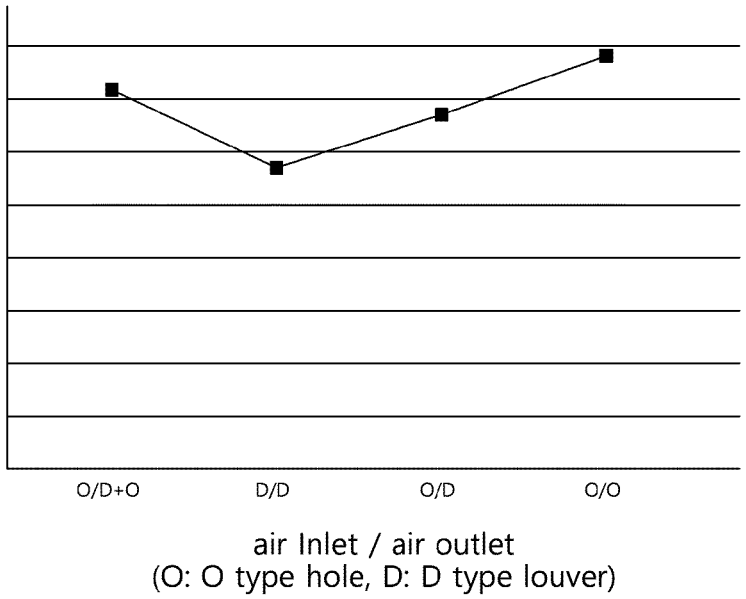

[Fig. 12]
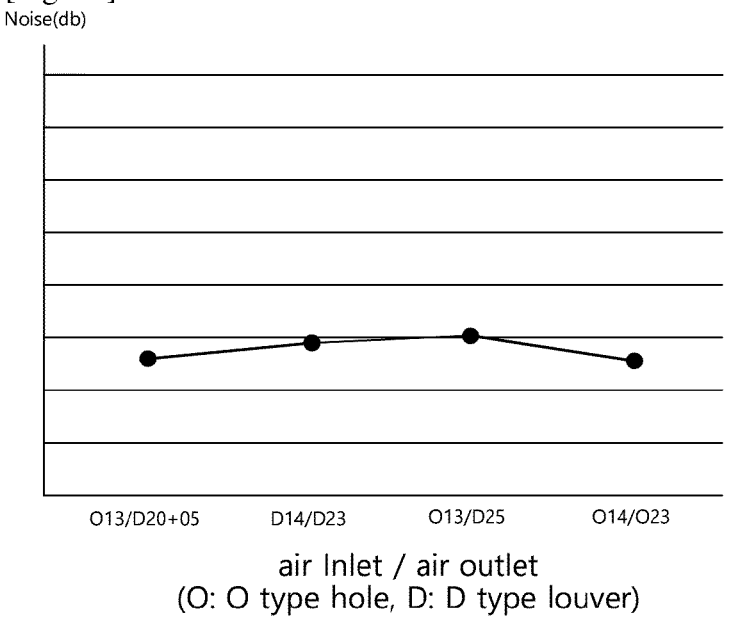
[Fig. 13]
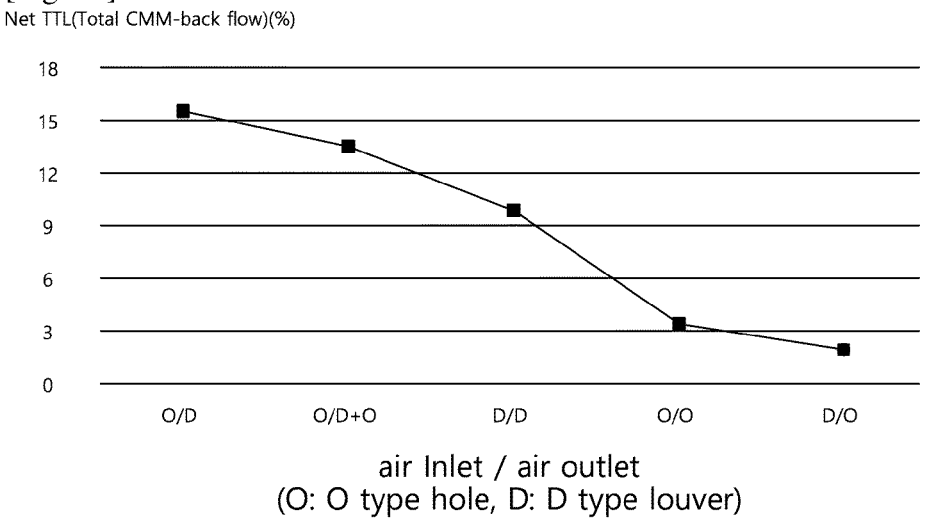
[Fig. 14]
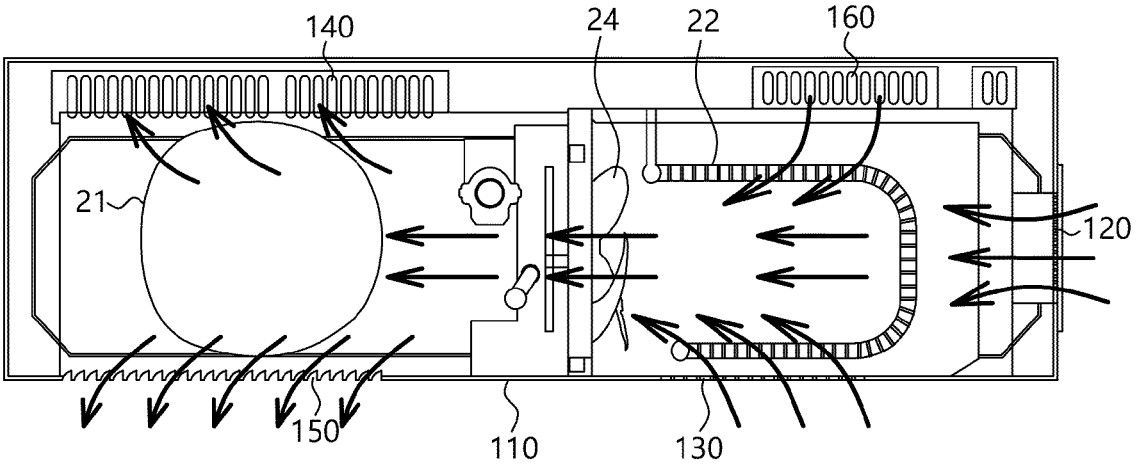

[Fig. 15]
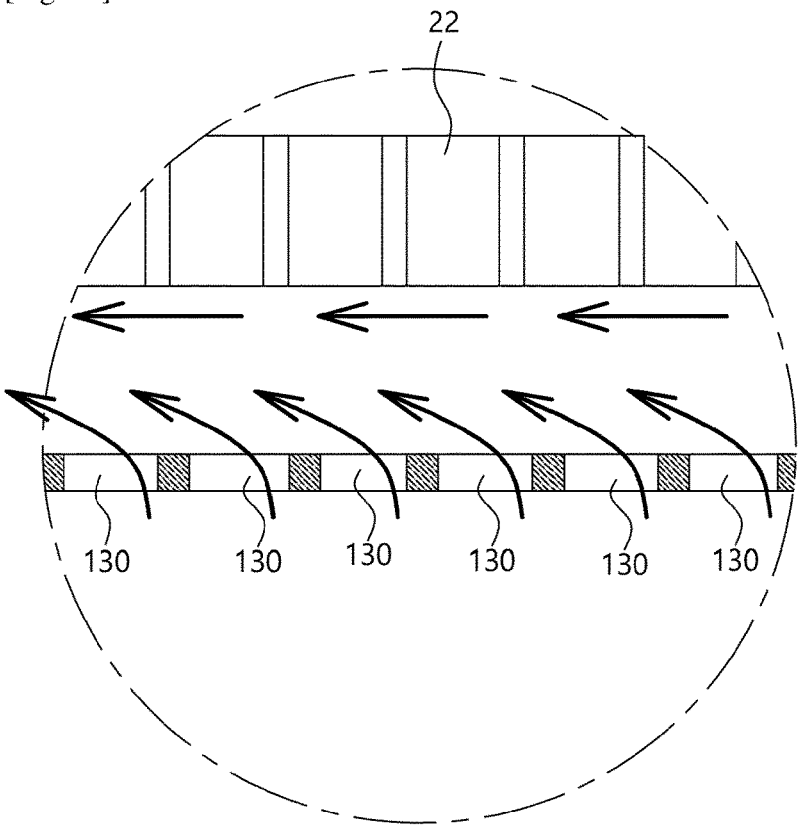
[Fig. 16]
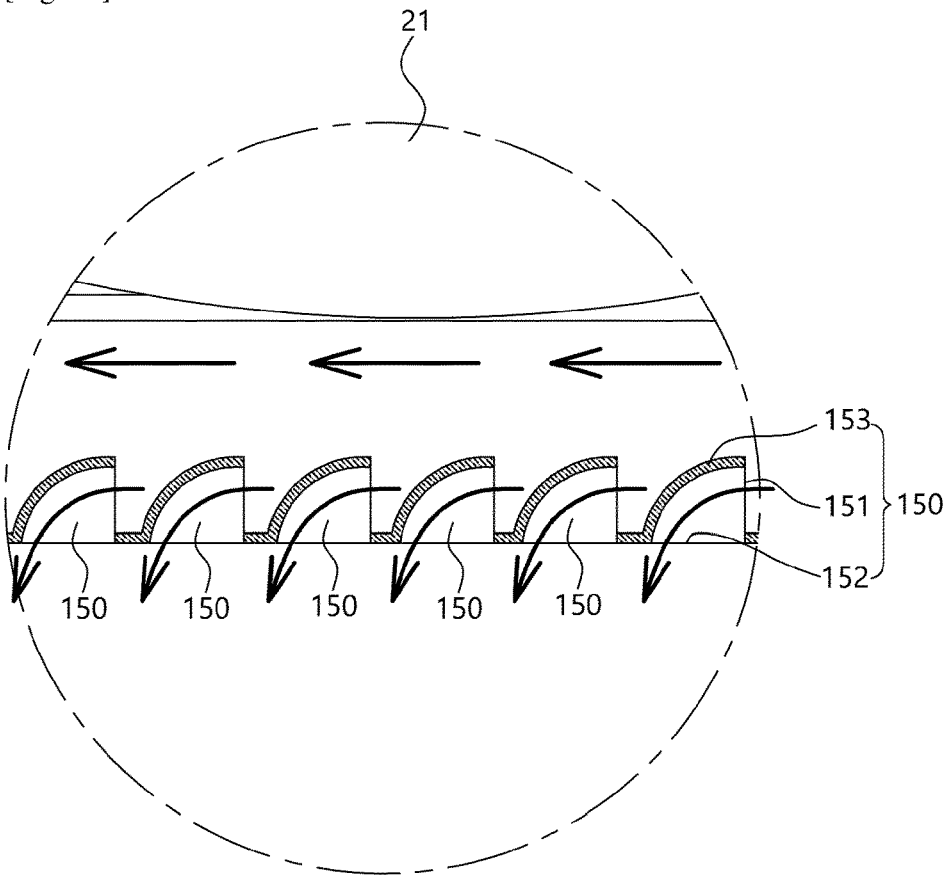

[Fig. 17]
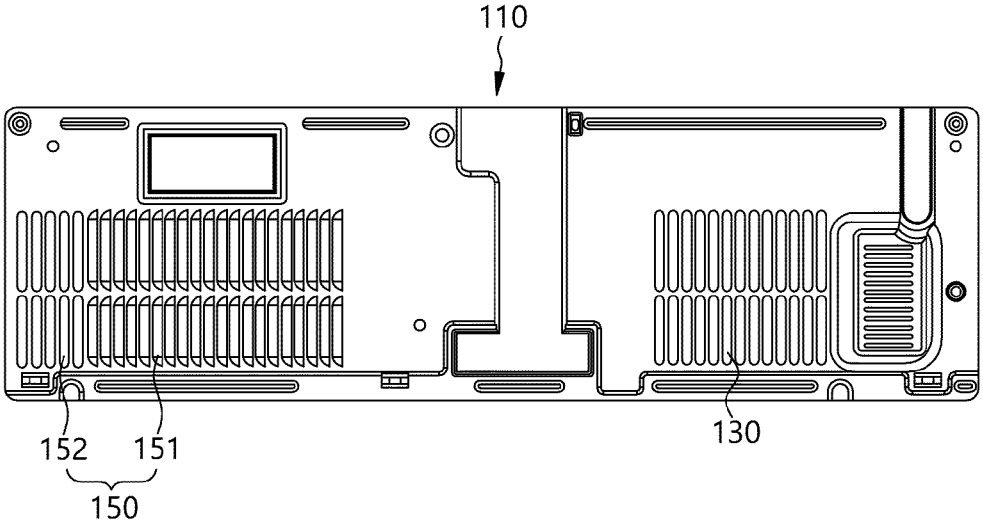
[Fig. 18]
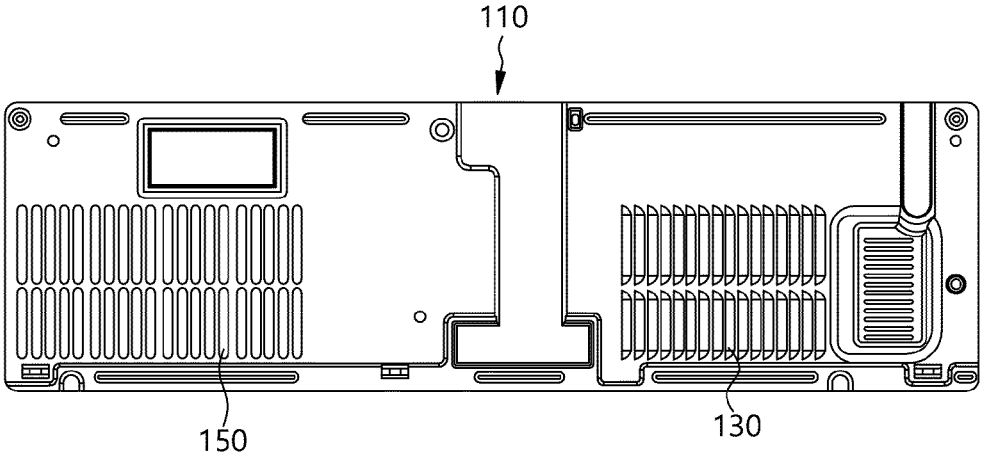

HOME APPLIANCES

CROSS-REFERENCE TO RELATED APPLICATIONS

This application is a National Phase application under 35 U.S.C. § 371 of International Application No. PCT/KR2022/003437, filed on Mar. 11, 2022, which claims benefit and priority to Korean Application No. 10-2021-0070680 filed on Jun. 1, 2021. The disclosures of the aforementioned applications are incorporated by reference in their entirety.

TECHNICAL FIELD

The present disclosure relates to a home appliance having a new type of machine room in which heat dissipation performance can be improved for reduction of power consumption.

BACKGROUND ART

In general, a home appliance refers to an appliance that uses electricity.

As such a home appliance, various apparatuses are provided in which cold air is generated by using the circulation of a refrigerant according to a cooling cycle so as to be used. In this case, the apparatuses may, for example, include a refrigerator, cooling or heating equipment, air conditioner, and air purifier, etc.

A home appliance having the cooling cycle described above is provided with a machine room for installing at least one of a compressor and a condenser.

The machine room is usually located at the rear of a bottom inside an appliance body constituting a home appliance, and is configured to be open at the rear surface of the machine room. In this case, a machine room cover is installed on the open rear surface of the machine room so as to selectively open the inside of the machine room.

In addition, an inlet and an outlet for introducing air into or discharging air from the associated machine room are formed on each wall surface of the machine room (opposite wall surfaces, a bottom surface, and the machine room cover). Accordingly, air circulation is repeated in such a manner that indoor air is introduced into the machine room through the inlet, passes sequentially through the condenser and the compressor to dissipate heat, and then is discharged through the outlet to an indoor space.

Meanwhile, recently, various efforts have been made to reduce power consumption by improving the performance of a home appliance.

For example, heat dissipation performance of the inside of the machine room is improved such that the performance of each of a compressor and a condenser located inside the machine room can be improved.

This is disclosed in Korean Patent Application Publication No. 10-2000-0033353, Korean Patent Application Publication No. 10-2000-0033742, and Korean Patent Application Publication No. 10-2009-0129033.

In a heat dissipation structure for a machine room of each of the prior arts as described above, an air flow is improved so as to improve the heat dissipation performance of the structure.

However, in the case of the above-described prior arts, there is a limit in improving heat dissipation because only a structure for improving air flow is provided, but a design that considers air inflow or outflow volume into the machine room is not made.

For example, in the case of the prior arts, an air inlet and an air outlet formed on a machine room cover are configured to have the shame shapes.

However, considering that air introduced into the air inlet contains a large amount of foreign matter, the air inlet is gradually blocked by such foreign matter, and thus there is a problem in that air inflow flow rate is insufficient.

In addition, in the case of the prior arts, air introduced through an air inlet into a machine room receives flow resistance due to each structure while flowing in the machine room, and thus not all of the introduced air is discharged through an air outlet to the outside of the machine room.

Furthermore, in the case of the prior arts, there were no attempts to reduce a back flow in which high-temperature air discharged to the outside of the machine room is reintroduced into the machine room, and thus it is very difficult to improve heat dissipation performance due to the back flow.

DISCLOSURE OF INVENTION

Technical Problem

The present disclosure has been made to solve various problems occurring in the related art described above, and the present disclosure is intended to improve the heat dissipation performance of the inside of the machine room by reducing a back flow in which high-temperature air discharged to an indoor space after flowing in the machine room is reintroduced directly into the machine room.

Furthermore, the present disclosure is intended to allow air introduced into the machine room to be sufficiently discharged therefrom so as to increase effective air volume, thereby improving heat dissipation performance and reducing power consumption.

Solution to Problem

In order to achieve the above objectives, according to the home appliance of the present disclosure, a machine room cover may include a plurality of air inlets through which air is introduced thereinto, and a plurality of air outlets through which air is discharged therefrom.

According to the home appliance of the present disclosure, each of the air inlets and each of the air outlets formed on the machine room cover may be configured to have flow rates different from each other.

According to the home appliance of the present disclosure, at least any one of the air inlet and the air outlet may be configured as a hole formed through the machine room cover perpendicularly thereto.

According to the home appliance of the present disclosure, at least any one of the air inlet and the air outlet may be configured as a bent louver structure to guide the flow direction of air.

According to the home appliance of the present disclosure, any one of the air inlet and the air outlet may be configured as a hole formed through the machine room cover perpendicularly thereto.

According to the home appliance of the present disclosure, the remaining one of the air inlet and the air outlet may be configured as a bent louver structure to guide the flow direction of air.

According to the home appliance of the present disclosure, the air inlet may be configured as a hole formed through the machine room cover perpendicularly thereto.

According to the home appliance of the present disclosure, the air outlet may be configured as a bent louver structure to guide the flow direction of air.

According to the home appliance of the present disclosure, the air outlet of the louver structure may be bent such that air inside the machine room is discharged to the outside of the machine room toward a direction opposite to a side toward which the air inlet is located.

According to the home appliance of the present disclosure, the air outlet of the louver structure may be configured to protrude toward the inside of the machine room.

According to the home appliance of the present disclosure, the air outlet of the louver structure may be configured to have an introduction opening into which air flowing in the machine room is introduced.

According to the home appliance of the present disclosure, the air outlet of the louver structure may be configured to have an exit opening through which air of the inside of the machine room introduced through the introduction opening is discharged to the outside of the machine room.

According to the home appliance of the present disclosure, the air outlet of the louver structure may include a connection part connecting the introduction opening with the exit opening.

According to the home appliance of the present disclosure, at least a portion of the connection part constituting the air outlet having a louver structure may be configured to be round.

According to the home appliance of the present disclosure, the air inlet may be configured to have a larger open area than the air outlet.

According to the home appliance of the present disclosure, the air inlet and the air outlet may be configured to have open areas having sizes different from each other.

According to the home appliance of the present disclosure, the air inlet may be configured to have a larger flow rate than the air outlet.

According to the home appliance of the present disclosure, the air outlet may be configured such that air discharged to the outside of the machine room flows toward a side opposite to a direction in which the air inlet is formed.

According to the home appliance of the present disclosure, each of at least some air outlets of the air outlets may be configured as a bent louver structure to guide the flow direction of air.

According to the home appliance of the present disclosure, each of at least some air outlets of each of the air outlets may be configured as a hole formed through the machine room cover perpendicularly thereto.

According to the home appliance of the present disclosure, the air outlet having the louver structure may be located to be more adjacent to the air inlet than the hole-shaped air outlet.

According the home appliance of the present disclosure, the sum of open areas provided by all of the air outlets of the machine room cover may be larger than the sum of open areas provided by all of the air inlets of the machine room cover.

According the home appliance of the present disclosure, each of the air inlets and each of the air outlets may be configured to have shapes different from each other.

Advantageous Effects of Invention

As described above, the home appliance of the present disclosure may have the following effects.

According to the home appliance of the present disclosure, each of the air inlets and each of the air outlets formed on the machine room cover may be configured to have flow rates different from each other, thereby facilitating design for the volume of air introduced into the machine room and the volume of air discharged to the outside of the machine room from the inside thereof.

According to the home appliance of the present disclosure, at least any one of the air inlet and the air outlet formed on the machine room cover may be configured as a hole, thereby maximizing the amount of air flowing in the machine room.

According to the home appliance of the present disclosure, at least any one of the air inlet and the air outlet formed on the machine room cover may be configured as a louver structure so as to give directionality to the inflow or outflow of air, thereby reducing an air back flow.

According to the home appliance of the present disclosure, each of the air inlets formed on the machine room cover may be configured as a hole, and each of the air outlets may be configured as a louver structure, thereby increasing the volume of air and preventing an air back flow.

BRIEF DESCRIPTION OF DRAWINGS

FIG. 1 is a perspective view illustrating the front state of a home appliance according to the embodiment of the present disclosure.

FIG. 2 is a perspective view illustrating the rear state of the home appliance according to the embodiment of the present disclosure.

FIG. 3 is a side sectional view illustrating the internal structure of the home appliance according to the embodiment of the present disclosure.

FIG. 4 is a perspective view illustrating the internal structure of a machine room of the home appliance according to the embodiment of the present disclosure.

FIG. 5 is a top plan view illustrating the internal structure of the machine room of the home appliance according to the embodiment of the present disclosure.

FIG. 6 is a rear view illustrating the internal structure of the machine room of the home appliance according to the embodiment of the present disclosure.

FIG. 7 is a view illustrating the state of a machine room cover of the home appliance according to the embodiment of the present disclosure.

FIG. 8 is an enlarged view of an "A" part of FIG. 5.

FIG. 9 is an enlarged view of a "B" part of FIG. 5.

FIG. 10 is a graph illustrating a back flow rate and a power consumption reduction rate for each combination of the shapes of the air inlet and the air outlet of the home appliance according to the embodiment of the present disclosure.

FIG. 11 is a graph illustrating a discharge area for each combination of the shapes of the air inlet and the air outlet of the home appliance according to the embodiment of the present disclosure.

FIG. 12 is a graph illustrating noise for each combination of the shapes of the air inlet and the air outlet of the home appliance according to the embodiment of the present disclosure.

FIG. 13 is a graph illustrating effective air volume for each combination of the shapes of the air inlet and the air outlet of the home appliance according to the embodiment of the present disclosure.

FIG. 14 is a view illustrating the state of an air flow inside the machine room during the operation of the home appliance according to the embodiment of the present disclosure.

FIG. 15 is a view illustrating a state in which air is introduced into the machine room through the air inlet of the machine room cover during the operation of the home appliance according to the embodiment of the present disclosure.

FIG. 16 is a view illustrating a state in which air is discharged from the machine room through the air outlet of the machine room cover during the operation of the home appliance according to the embodiment of the present disclosure.

FIGS. 17 and 18 are views respectively illustrating other embodiments of the machine room cover of the home appliance according to the embodiment of the present disclosure.

MODE FOR THE INVENTION

Prior to description, a home appliance of the present disclosure may be a product having a cooling cycle, and more specifically, a product having a structure in which some of devices constituting the cooling cycle are disposed in the machine room.

In an embodiment below, the home appliance is a refrigerator as an example, and the machine room of the home appliance is a machine room of the refrigerator as an example.

Hereinafter, the exemplary embodiment of the home appliance of the present disclosure will be described.

In the home appliance of the present disclosure, each of air inlets and each of air outlets formed on a machine room cover may be configured to have flow rates different from each other. Accordingly, effective air volume may be increased so as to improve heat dissipation performance and reduce power consumption.

This will be described in more detail with reference to FIGS. 1 to 18 hereinbelow.

FIG. 1 is a perspective view illustrating the front state of a home appliance according to the embodiment of the present disclosure, FIG. 2 is a perspective view illustrating the rear state of the home appliance according to the embodiment of the present disclosure, and FIG. 3 is a side sectional view illustrating the internal structure of the home appliance according to the embodiment of the present disclosure.

This will be described in more detail with reference to the illustrated contents of each drawing.

First, the home appliance (a refrigerator) according to the embodiment of the present disclosure may include an appliance body 1.

The appliance body 1 may be a component constituting the exterior of the home appliance.

A storage compartment 11 may be provided in the appliance body 1. The storage compartment 11 which is a storage space for storing items may include at least one storage compartment 11 provided in the appliance body 1.

As illustrated in FIG. 1, the storage compartment 11 may be opened and closed by a door 1*a*.

Furthermore, the machine room 100 may be provided in the appliance body 1. The machine room 100 may be space provided to install some devices constituting a cooling cycle.

In this case, devices constituting the cooling cycle may include at least one compressor 21, a condenser 22, an expander (not shown), and an evaporator 23.

Such a machine room 100 may be configured to have space partitioned from the storage compartment 11.

In addition, the machine room 100 may be located at the lower end of the appliance body 1. More specifically, as illustrated in FIG. 2, the machine room 100 may be located on the rear of the lower end of the appliance body 1.

Of course, although not shown, the machine room 100 may be located on a front or side of the lower end of the appliance body 1, an entire lower end thereof, or a portion of the upper end of the appliance body 1.

FIG. 4 is a perspective view illustrating the internal structure of the machine room of the home appliance according to the embodiment of the present disclosure, FIG. 5 is a top plan view illustrating the internal structure of the machine room of the home appliance according to the embodiment of the present disclosure, and FIG. 6 is a rear view illustrating the internal structure of the machine room of the home appliance according to the embodiment of the present disclosure.

As illustrated in these drawings, at least one of the compressor 21, the condenser 22, and a cooling fan 24 may be provided in the machine room 100 of the home appliance according to the embodiment of the present disclosure. Specifically, the compressor 21, the condenser 22, and the cooling fan 24 may together be provided in the machine room 100.

Here, the compressor 21 and the condenser 22 may be sequentially disposed in the longitudinal direction of the machine room 100 (in opposite-side directions when viewed from the front surface of the home appliance).

The compressor 21 may function to compress refrigerant of the cooling cycle, and the condenser 22 may function to condense refrigerant compressed by the compressor 21. The cooling fan 24 may function to generate the flow of air outside the machine room 100 such that the air is heat-exchanged with the condenser while passing through the condenser.

In this case, the cooling fan 24 may be located between the compressor 21 and the condenser 22 and may be configured to function to lower the temperature of the compressor 21 while air passing through the condenser 22 passes through the compressor 21.

Furthermore, the machine room 100 may include a rear surface, opposite side surfaces, and a bottom surface. In this case, the rear surface of the machine room 100 may be configured to be open, and the machine room cover 110 may be provided on the open rear surface of the machine room 100. That is, the machine room cover 110 may substantially constitute the rear surface of the machine room 100.

Furthermore, as illustrated in FIGS. 4 to 7, a plurality of air inlets 120, 130, and 160 and a plurality of air outlets 140 and 150 may be formed on at least one wall surface of the machine room 100.

The air inlets 120, 130, and 160 may be parts configured such that air of the outside (for example, an indoor space) of the machine room is introduced into the machine room 100.

Air inlets 120 of the plurality of air inlets 120, 130, and 160 described above may be formed on any one side surface of the machine room 100. That is, air outside the machine room may be introduced into the machine room 100 through the air inlets 120 formed on any one side surface of the machine room 100.

In this case, any one side surface on which the air inlets 120 are formed may be a wall surface of a side at which the condenser 22 is located relative to the center of the inside of the machine room.

In addition, air inlets 130 of the plurality of air inlets 120, 130, and 160 may be formed on the rear surface of the machine room 100. That is, the air inlets 130 may be formed on the machine room cover 110 constituting the rear surface of the machine room 100, and air outside the machine room may be introduced through the air inlets 130 formed on this manner into the machine room 100.

The air inlets 130 formed on the machine room cover 110 may be formed on a side at which the condenser 22 is located in the opposite side portions of the machine room cover 110. Accordingly, air introduced into the machine room 100 through the air inlets 130 due to the operation of the cooling fan 24 may first pass through the condenser 22, pass through the cooling fan 24, and then may flow to the compressor 21.

The air inlets 160 of the plurality of air inlets 120, 130, and 160 may be formed on the bottom surface of the machine room 100. In this case, it may be preferable that the air inlets 160 are formed at a side at which the condenser 22 is located.

In addition, the air outlets 140 and 150 may be parts configured such that air of the inside of the machine room 100 is discharged to the outside of the machine room therethrough.

The air outlets 140 of the plurality of air outlets 140 and 150 may be formed on the bottom surface of the machine room 100. That is, a plurality of air outlets 140 may be formed on the bottom surface of the machine room 100, and air inside the machine room 100 may be discharged through the air outlets 140 formed on this manner to the outside.

In addition, the air outlets 150 of the plurality of air outlets 140 and 150 may be formed on the rear surface of the machine room 100. That is, the air outlets 150 may be formed on the machine room cover 110 constituting the rear surface of the machine room 100, and air inside the machine room 100 may be discharged through the air outlets 150 formed on this manner to the outside.

The air outlets 150 formed on the machine room cover 110 may be formed on a side at which the compressor 21 is located in the opposite side portions of the machine room cover 110. Accordingly, air introduced into the machine room 100 due to the operation of the cooling fan 24 may sequentially pass through the condenser 22, the cooling fan 24, and the compressor 21 and then may be discharged to the outside of the machine room 100.

Meanwhile, in the embodiment of the present disclosure, each of the air inlets 130 and each of the air outlets 150 formed on the machine room cover 110 may be configured to have flow rates different from each other.

For an example, any one of the air inlet 130 and the air outlet 150 may be configured as a hole formed through the machine room cover 110 perpendicularly thereto.

For example, as illustrated in FIG. 8, the air inlet 130 may be configured as a hole. That is, a simple hole may have a larger opening and less air resistance than a non-hole shape, and thus a greater flow rate of air may be introduced and clogging caused by foreign matter may be reduced.

In this case, the hole may be a circular through hole, or may be an oval or a long slot in one direction, such as a track type. Of course, the hole may be configured as a polygonal slot or a polygonal through hole. In addition, the hole may include holes configured to form a plurality of vertical columns, or to form a plurality of horizontal rows.

For another example, any one of the air inlet 130 and the air outlet 150 may be configured as a louver structure formed by being bent from the machine room cover 110.

In this case, the louver structure may be a structure configured such that the associate portion of the machine room cover 110 is bent by punching and pressing the machine room cover 110. For example, as illustrated in FIG. 7, the louver structure may be configured as a structure having a D-shaped outer surface. Due to such a louver structure, the flow direction of air passing through the associated portion may be guided.

For example, as illustrated in FIG. 9, the air outlet 150 may be configured as a louver structure. That is, in a process in which air inside the machine room 100 is discharged through the air outlet 150 to the outside, the flow of the air may be guided in a direction other than a portion toward which the air inlet 130 of the machine room cover 110 is formed. Accordingly, a back flow in which the discharged air is reintroduced directly through the air inlet 130 into the machine room may be prevented or minimized.

Due to the prevention or minimization of such a back flow, air having an increased temperature while passing through the compressor 21 may be prevented from being reintroduced into the air inlet 130, and accordingly, a heat exchange defect and the deterioration of a heat exchange performance caused by high-temperature air supplied to the condenser 22 may be prevented.

For another example, each of the air inlets 130 and each of the air outlets 150 formed on the machine room cover 110 may be configured to have shapes different from each other.

For example, any one of the air inlet 130 and the air outlet 150 may be configured as a hole formed through the machine room cover 110 perpendicularly thereto, and the remaining one thereof may be configured as a louver structure formed by being bent from the machine room cover 110.

Here, it may be advantageous that the shape of the hole can secure the maximum flow rate of air passing through the hole, and the shape of the louver structure can guide an air flow in a desired direction.

Preferably, the air inlet 130 may be configured as a hole and the air outlet 150 may be configured as a louver structure. That is, the flow rate of air introduced into the air inlet 130 may be increased, and the air inlet 130 may be prevented from being clogged, and the reintroduction of air discharged to the outside through the air outlet 150 into the air inlet 130 may be prevented or minimized so as to improve cooling performance such that power consumption can be reduced and heat dissipation performance can be improved.

The graph of FIG. 10 illustrates a power consumption reduction rate and a back flow rate according to the shapes of the air inlet 130 and the air outlet 150. As can be seen from this, when the air inlet 130 of the machine room cover 110 is configured as a hole and the air outlet 150 is configured as a louver structure, power consumption and a back flow may be reduced.

In addition, as can be seen from the graph of FIG. 11, when the air inlet 130 of the machine room cover 110 is configured as a hole and the air outlet 150 is configured as a louver structure, a sufficient discharge area may be secured, and as can be seen from the graph of FIG. 12, the standard of noise generated during an air flow may be satisfied by a conventional structure (O/O type structure).

Particularly, as for an effective air volume excluding a backflow air volume from a total air volume flowing into the machine room 100, when the air inlet 130 is configured as a hole and the air outlet 150 is configured as a louver structure, the effective air volume may have the highest rise rate. This can be seen through the graph of FIG. 13. That is, the overall effective air volume may be increased by reducing a flow resistance on an air inlet side and reducing a back flow on an air outlet side.

The air outlet 150 having a louver structure may include an introduction opening 151 into which air flowing in the machine room 100 is introduced.

The air outlet 150 of the louver structure may include an exit opening 152 through which air of the inside of the machine room 100 is discharged to the outside of the machine room 100.

The air outlet 150 having the louver structure may include a connection part 153 connecting the introduction opening 151 with the exit opening 152.

Particularly, as described above, in the case in which the air outlet 150 is configured as a louver structure, the connection part 153 of the air outlet 150 of the louver structure may be configured to be bent such that air inside the machine room 100 is discharged to the outside of the machine room 100 in a direction opposite to a side toward which the air inlet 130 is located. In this case, the bending may include inclining, at least partially rounding, or entirely rounding.

That is, air discharged to the outside of the machine room 100 by the guidance of the connection part 153 constituting the air outlet 150 may flow in a direction opposite to a side toward which the air inlet 130 is located, and thus may be prevented from mixing with air introduced into the machine room 100 through the air inlet 130.

Of course, even if the air outlet 150 is not configured as a louver structure, each of the air outlets 150 is preferably configured to guide air flowing through the associated air outlet 150 such that the air flows toward a side opposite to a direction in which the air inlet 130 is formed.

When the air inlet 130 is configured as a louver structure, the air inlet 130 is preferably configured in a direction opposite to a portion toward which the air outlet 150 is formed.

In addition, the air outlet 150 having the louver structure may be configured to protrude toward the inside of the machine room 100. Accordingly, a distance between the machine room cover 110 and a wall surface of an indoor space may further be secured, so the difficulty of the installation of the machine room cover or the flow resistance of air flowing between the machine room cover 110 and the wall surface of the indoor space may be decreased.

For another example, each of the air inlets 130 and each of the air outlets 150 may be configured to have open areas having sizes different from each other.

For example, the open area (an individual inlet area (IIA)) of the air inlet 130 may be formed to be larger than the open area (an individual outlet area (IOA)) of the air outlet 150.

Accordingly, the clogging of the air inlet 130 by foreign matter such as dust contained in air introduced through the air inlet 130 formed on the machine room cover 110 may be reduced. Additionally, the amount of air introduced through the machine room cover 110 into the machine room may be sufficiently secured.

Here, the individual outlet area (IOA) of the air outlet 150 may be preset as the open area of the exit opening 152. That is, the opening of a side through which the air is discharged may determine the amount of air discharged through the air outlet 150.

Of course, even without increasing the individual inlet area (IIA), each of the air inlets 130 may be configured to have a larger flow rate than each of the air outlets 150.

For example, although not shown, the air inlet may be configured to have a larger flow rate than the air outlet by additionally forming a separate guide in each of the air inlets 130 or by forming the shape of the air inlet 130 differently from the shape of the air outlet 150.

Meanwhile, it may be preferable that the sum of individual outlet areas (IOA) provided by all of the air outlets 150 of the machine room cover 110 is larger than the sum of individual inlet areas (IIA) provided by all of the air inlets 130 of the machine room cover 110.

That is, air introduced through the air inlet 130 into the machine room 100 may hit each device (for example, the compressor, the condenser, the cooling fan, and a circuit part, etc.) located inside the machine room 100 while passing through the inside of the machine room 100, so a sufficient amount of the air may not be discharged to the outside. Accordingly, the cover total outlet area (CTOA) of the machine room cover 110 is preferably formed to be larger than the cover total inlet area (CTIA) of the machine room cover 110 such that the loss of an air outflow rate due to a dead zone can be compensated and an effective air volume can be increased.

Hereinbelow, the heat dissipation process of the machine room 100 of the home appliance according to the embodiment of the present disclosure described above will be described in more detail with reference to FIGS. 14 to 16.

First, when the operating conditions of the cooling cycle provided in the home appliance are satisfied and the cooling cycle is operated, the compressor 21 in the machine room 100 may operate to circulate refrigerant.

In this case, repeated is a refrigerant flow in which refrigerant compressed by the operation of the compressor 21 is condensed while passing through the condenser 22, continuously passes sequentially through the expander (not shown) and the evaporator 23, and then is returned to the compressor 21.

Furthermore, when the operation of the compressor 21 described above is performed, the cooling fan 24 inside the machine room 100 may also be operated and thus air suction force may be generated in space in which the air inlet 130 is located.

Accordingly, as illustrated in FIGS. 14 and 15, air outside the machine room 100 may be introduced into the machine room 100 through the air inlets 130 formed on the machine room cover 110.

Of course, air outside the machine room 100 may be introduced into the machine room 100 even through the air inlets 120 and 160 formed on other wall surfaces of the machine room 100, and air introduced in this manner and air introduced through the air inlet 130 of the machine room cover 110 may be heat-exchanged with the condenser 22 while passing through the condenser 22.

In this case, the air inlet 130 formed on the machine room cover 110 may be configured as a simple hole, and thus air outside the machine room 100 may efficiently pass through the air inlet 130, and foreign matter contained in the air outside the machine room 100 may be prevented from being accumulated in the air inlet.

In addition, air heat-exchanged with the condenser 22 may pass through the cooling fan 24 and may be discharged to the compressor 21 to dissipate heat of the compressor 21 and then may be discharged to the outside of the machine room 100 through the air outlet 150 formed on the machine room cover 110. Of course, the air by which the heat of the compressor is dissipated may be discharged to the outside of the machine room 100 even through the air outlet 140 formed on the bottom surface of the machine room 100.

Particularly, the air outlet 150 of the machine room cover 110 may be configured as a louver structure, and thus as illustrated in FIG. 16, by the guidance of the curve or inclination of the connection part 153, air discharged through the air outlet 150 may flow toward a side opposite to a side toward which the air inlet 130 of the machine room cover 110 is located.

Accordingly, a back flow in which the discharged air is reintroduced into the air inlet 130 may be prevented or only minimally performed.

Furthermore, in the home appliance according to the embodiment of the present disclosure, the total outflow area (CTOA) of the machine room cover 110 may be larger than the total inflow area (CTIA) of the machine room cover 110, and thus even if external air introduced into the machine room 100 has flow resistance by hitting each device while passing through the inside of the machine room 100, a sufficient amount of the external air may be discharged to the outside of the machine room.

Accordingly, since the loss of an air outflow rate due to a dead zone is compensated, an effective air volume may be increased, and since the effective air volume is increased even with the same power, power consumption efficiency may be improved.

Meanwhile, all of the air outlets 150 formed on the machine room cover 110 of the present disclosure may not be required to be formed to have the same shapes.

As an example, only a portion of at least one of the air inlet 130 and the air outlet 150 may be configured as a hole and the other portion thereof may be configured as a louver structure.

More specifically, as illustrated in FIG. 17, a portion 151 of the air outlets 150 may be configured as a louver structure formed by being bent from the machine room cover 110, and the other portion 152 of the air outlets 150 may be configured as a hole formed through the machine room cover 110 perpendicularly thereto. That is, the air outlet 150 may be configured to have a structure in which an air outflow rate and backflow rate are simultaneously considered.

In this case, the air outlet 151 having the louver structure may be located to be more adjacent to the air inlet 130 than the hole-shaped air outlet 152. That is, the air outlet 151 having the louver structure may be disposed at a side at which the air inlet 130 is formed such that an air back flow can be prevented and an air flow volume through the hole-shaped air outlet 152 can be secured.

In the case of the above-described structure (the air outlet is a structure in which a hole shape and a louver shape are mixed), the air inlet 130 may be configured as a hole formed through the machine room cover 110 perpendicularly thereto so as to secure the suction flow rate.

On the other hand, according to the home appliance of the present disclosure, as illustrated in FIG. 18, the air inlet 130 formed on the machine room cover 110 may be configured as a louver structure, and the air outlet 150 may be configured to have a hole shape.

Of course, the structure may have a higher back flow rate, a lower power consumption reduction rate, and a lower effective air volume than a structure in which the air outlet 150 formed on the machine room cover 110 is configured as a louver structure and the air inlet 130 is configured as a hole. This is illustrated in FIGS. 10 and 13.

As described above, according to the home appliance of the present disclosure, each of the air inlets 130 and each of the air outlets 150 formed on the machine room cover 110 may be configured to have flow rates different from each other, so design for the volume of air introduced into the machine room 100 and the volume of air discharged to the outside of the machine room 100 from the inside thereof may be facilitated.

Furthermore, according to the home appliance of the present disclosure, at least any one of the air inlet 130 and the air outlet 150 formed on the machine room cover 110 air outlet 150 may be configured as a hole, so the amount of air flowing in the machine room 100 may be maximized.

Furthermore, according to the home appliance of the present disclosure, at least any one of the air inlet 130 and the air outlet 150 formed on the machine room cover 110 may be configured as a louver structure so as to give directionality to the inflow or outflow of air, so an air back flow may be reduced.

Furthermore, according to the home appliance of the present disclosure, each of the air inlets 130 formed on the machine room cover 110 may be configured as a hole, and each of the air outlets 150 may be configured as a louver structure, so the volume of air may be increased and an air back flow may be prevented.

The invention claimed is:

1. An appliance comprising:

an appliance body, the appliance body having a machine room that is defined at a portion of the appliance body; and a machine room cover disposed at a surface of the machine room, wherein the machine room cover defines:

a plurality of air inlets configured to introduce air into the machine room, and a plurality of air outlets configured to discharge air from the machine room to an outside of the machine room, wherein an inlet flow rate of air through each of the plurality of air inlets is different from an outlet flow rate of air through each of the plurality of air outlets, wherein the plurality of air inlets includes one or more holes that pass through the machine room cover and extend in a direction perpendicular to a surface of the machine room cover, and wherein the plurality of air outlets includes one or more slits that are curved and configured to define a flow direction of air.

2. The appliance of claim 1, wherein the one or more slits are curved to thereby discharge air in a direction away from the plurality of air inlets.

3. The appliance of claim 1, wherein the one or more slits comprise protrusions that protrude toward an inside of the machine room.

4. The appliance of claim 1, wherein each of the plurality of air outlets comprises:

an introduction opening configured to receive air from an inside of the machine room;

an exit opening configured to discharge the air received through the introduction opening to the outside of the machine room; and a connection part that connects the introduction opening to the exit opening.

5. The appliance of claim 4, wherein the connection part is curved.

6. The appliance of claim 4, wherein an open area of one of the plurality of air inlets is larger than an open area of one of the plurality of air outlets.

7. The appliance of claim 6, wherein the open area of one of the plurality of air outlets is equal to an open area of the exit opening.

8. The appliance of claim 1, wherein an open area of one of the plurality of air inlets is different from an open area of one of the plurality of air outlets.

9. The appliance of claim 8, wherein the open area of one of the plurality of air inlets is larger than the open area of one of the plurality of air outlets.

10. The appliance of claim 1, wherein the inlet flow rate is greater than the outlet flow rate.

11. The appliance of claim 1, wherein each of the plurality of air outlets is configured to guide air toward a side opposite to the plurality of air inlets.

12. An appliance comprising:

an appliance body, the appliance body having a machine room that is defined at a portion of the appliance body; and a machine room cover disposed at a surface of the machine room, wherein the machine room cover defines:

a plurality of air inlets configured to introduce air into the machine room, and a plurality of air outlets configured to discharge air from the machine room to an outside of the machine room, wherein an inlet flow rate of air through each of the plurality of air inlets is different from an outlet flow rate of air through each of the plurality of air outlets, wherein each of the plurality of air inlets includes a hole that passes through the machine room cover and extends in a direction perpendicular to a surface of the machine room cover, and wherein a first portion of the plurality of air outlets includes one or more slits that are curved and configured to define a flow direction of air.

13. The appliance of claim 12, wherein a second portion of the plurality of air outlets includes one or more holes that pass through the machine room cover and extend in a direction perpendicular to a surface of the machine room cover.

14. The appliance of claim 13, wherein the plurality of air inlets are disposed closer to the first portion of the plurality of air outlets than to the second portion of the plurality of air outlets.

15. The appliance of claim 12, wherein a sum of open areas of the plurality of air outlets is greater than a sum of open areas of the plurality of air inlets.

* * * * *